US006332822B2

(12) United States Patent
Greenberg et al.

(10) Patent No.: US 6,332,822 B2
(45) **Date of Patent: *Dec. 25, 2001**

(54) SOFT DIVING STICK

(75) Inventors: Michael Greenberg, Gladstone; Richard J. Greenberg, Warren; Michael A. Waters, Delran, all of NJ (US)

(73) Assignee: Shelcore, Inc., Somerset, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/339,831

(22) Filed: Jun. 25, 1999

(51) Int. Cl.[7] ..... A63H 23/00
(52) U.S. Cl. ..... 446/153; 446/396
(58) Field of Search ..... 446/156, 153, 446/166, 167, 267, 369, 396

(56) References Cited

U.S. PATENT DOCUMENTS

| | | | | |
|---|---|---|---|---|
| 2,297,727 | | 10/1942 | Svoboda et al. . | |
| 2,674,065 | | 4/1954 | Sprinkle . | |
| 3,129,528 | | 4/1964 | Gausewitz . | |
| 3,183,002 | | 5/1965 | Updaw . | |
| 3,392,483 | | 7/1968 | Beatty, Sr. . | |
| 3,707,289 | * | 12/1972 | Wicks | 273/139 |
| 3,713,250 | | 1/1973 | Clough, Jr. . | |
| 4,144,670 | | 3/1979 | Gearhart . | |
| 4,198,780 | | 4/1980 | Kubiatowicz . | |
| 4,268,989 | * | 5/1981 | Wickham | 446/153 |
| 4,549,871 | * | 10/1985 | Verney | 446/153 |
| 4,552,539 | * | 11/1985 | Hoenstine | 441/66 |
| 4,588,618 | * | 5/1986 | Wolfe | 446/153 |
| 4,622,019 | * | 11/1986 | Katzman et al. | 446/153 |
| 4,662,627 | | 5/1987 | Utley . | |
| 4,799,910 | * | 1/1989 | Kellough | 441/131 |
| 5,009,413 | * | 4/1991 | Allen | 446/153 |
| 5,009,623 | * | 4/1991 | Lueschen | 441/56 |
| 5,017,171 | * | 5/1991 | Shiina . | |
| 5,174,477 | * | 12/1992 | Shafer | 222/183 |
| 5,722,871 | * | 3/1998 | Zamir | 446/153 |
| 5,733,166 | * | 3/1998 | Hoag | 446/75 |
| 5,810,364 | * | 9/1998 | Canion | 273/459 |
| 5,865,662 | * | 2/1999 | Dammann | 446/153 |
| 6,000,111 | * | 12/1999 | Deskins et al. | 24/712.3 |
| 6,022,024 | * | 2/2000 | Kahn | 273/317 |

FOREIGN PATENT DOCUMENTS

2244658-A * 11/1991 (GB) .

OTHER PUBLICATIONS

Swimline—Inflatables/Trainers—Dive Games 1, "Deluxe Dive Sticks" (Style 9129), www.swimline.com/games/dive/index.html, Jun. 18, 1999.
Shelcore Toys Retail Partners Page, "Diving Sticks" (Item 51613), www.shelcore.com/water5.html, Jun. 23, 1999.
"U.S. Pushes for Ban on Dive Sticks," *Washington Post* Newspaper, Business Section E, pp. 1 and 12, Jun. 25, 1999.
Mayer, C.E.; "U.S. Pushes for Ban on Dive Sticks", The Washington Post; E1,E12, Jun. 25, 1999.*

* cited by examiner

*Primary Examiner*—Jacob K. Ackun, Jr.
*Assistant Examiner*—Kevin M Hughes
(74) *Attorney, Agent, or Firm*—Bacon & Thomas

(57) ABSTRACT

A diving stick of the type which, after being tossed into a swimming pool, sinks to the bottom while maintaining an upright posture so that it can easily be grasped by a diver, includes a soft malleable outer body designed to prevent accidental impalement, and provisions for enabling the diving stick to sink and maintain an upright posture at the bottom of the pool despite the buoyancy of the soft malleable material.

9 Claims, 1 Drawing Sheet

SOFT DIVING STICK

BACKGROUND OF THE INVENTION

1. Field of the Invention

The present invention generally relates to a diving stick, and in particular to a diving stick made of a material soft and pliable enough to prevent injury to a person by impalement.

2. Description of the Related Art

Diving sticks are sticks that include weights at one end so that, when tossed into a swimming pool, the sticks will stand upright on the pool floor for easy retrieval by a diver. Such sticks may be used for recreation or for the purpose of enhancing diving skills.

Recently, it has become apparent that conventional dive sticks can cause injury by impaling persons who land on them. While only seven children have been reported injured according to an article in The Washington Post dated Jun. 25, 1999, the nature of the injuries, rectal or vaginal impalement, is so severe that the sticks are considered to be a serious hazard, and it has been proposed to completely ban the import and manufacture of diving sticks.

Conventionally, diving sticks are made of a rigid, water impermeable material and must be partially filled with ballast having sufficient weight to cause the stick to sink, weighted end first, and stand upright at the bottom of the pool. For example, Swimline offers a "Promotional Style Dive Sticks Underwater Game" made up of sand-filled, weighted sticks that are said to stand upright on the pool floor for easy retrieval, while Shelcore Toys, Inc. has in the past offered non-weighted diving sticks made of a relatively light material that is pre-filled with water to a desired level in order to overcome the buoyancy of the material. Such sticks are inexpensive and effective for their intended purpose of providing an object that can easily be retrieved from the bottom of the pool but depend on the impermeability and rigidity of the material to enable the sticks to perform in the intended manner and therefore present an inherent risk of impalement, leading to the proposals to ban all diving sticks.

One possible solution to the problem of impalements is simply to make the tubes of a soft material, but available soft materials such as cloth or fabric and PVC are generally too light to sink, even when filled with water, and when weighted sufficiently to overcome the natural buoyancy of the material, become just as hazardous as the more rigid but lighter conventional diving sticks. In addition, a certain amount of air must be retained in the diving stick to permit it to stand upright at the bottom of the pool so that it can easily be grasped by a diver, which precludes use of conventional soft, water permeable toys as diving sticks. While valves, tubes, and the like offer the possibility of buoyancy control and could be used in relatively soft objects, such arrangements are too complex to be commercially viable, and are thus not suitable for use in the context of the invention. As a result, none of the currently available diving sticks are made of a soft material.

Numerous underwater toys underwater toys with provision for controlling or varying buoyancy and orientation have also previously been proposed or sold, but none are suitable for use as diving sticks. In most diving toys having a variable buoyancy, the rate or level of descent is controlled by adding air through a straw, tube, or closeable valve structure, and thus are too complex to be commercially viable for use a diving sticks, and/or are inconvenient to use.

For example, U.S. Pat. Nos. 4,662,627, 3,713,250, 3,392,483, and 2,297,727 disclose toys that require air hoses or straws for buoyancy control, and thus are not only relatively complex in addition to being unsuitable for use in deep water. Similarly, U.S. Pat. No. 5,722,871 discloses a variable buoyancy device that requires a relatively complex manually-controlled valve structure to control buoyancy, and U.S. Pat. No. 4,198,780 discloses a toy that utilizes gas generated internally by wetting baking powder in a cavity in the toy. On the other hand, U.S. Pat. No. 5,810,364, which describes a treasure chest toy that must be filled with sand by a user before being tossed into a swimming pool, and which would present the same impalement hazard as the conventional diving sticks if shaped in a similar manner.

At present, there is an urgent need for improvements in the safety of diving sticks, and in particular the provision of a soft, pliable diving stick that cannot impale a person, and yet that has an elongate shape so that it can easily be grasped and that functions in the same way as a conventional diving stick.

SUMMARY OF THE INVENTION

It is therefore a first objective of the invention to provide a diving stick of the type which is intended to be tossed into a swimming pool and sink below the surface of the pool to a position where it can be grasped by a diver, and yet that is made of a material that is soft and malleable enough to avoid risk of injury by impalement.

It is a second objective of the invention to provide a soft, pliable, and lightweight diving stick that will sink to the bottom of a swimming pool and maintain a predetermined or upright posture without requiring the user to fill it with water or other substances prior to use.

It is a third objective of the invention to provide a soft, pliable, and lightweight diving stick that does not require the inclusion of valves, straws, or other buoyancy control devices in order to maintain an upright posture at the bottom of the pool.

These objectives of the invention are achieved, in accordance with the principles of a first preferred embodiment of the invention, by providing a diving stick in the form of a tube made of a soft, malleable, liquid impermeable material such as rubber or softened polyvinyl chloride (PVC), in which is placed at one end a weight that is insufficient to overcome the natural buoyancy of the material, but that provides a preferred orientation for the stick when sinking and that causes the end of the stick to dip slightly in the water when the stick is initially tossed or placed in a swimming pool. In order to cause the diving stick of this embodiment of the invention to sink, the tube includes, adjacent the weighted end, an opening through which water will enter the tube and, at the other end, at least one opening through which air is expelled from the tube under pressure of the water entering the tube at the weighted end. The opening at the other end is positioned a sufficient distance from the end of the stick to enable a pocket of air to remain in the stick after it has filled with water and begun sinking, enabling the stick to maintain an upright posture at the bottom of the pool.

The objectives of the invention are also achieved, in accordance with the principles of a second preferred embodiment of the invention, by providing a diving stick made of a soft, pliable, water permeable material such as polyester, nylon, or natural cloth or fabric materials, having a weight at one end. At least a portion at the end opposite the weighted end of the diving stick is filled with a loose fibrous material such as polyfill, which entraps air as water is absorbed into the interior of the stick, thus serving maintain an upright posture.

More generally, the objectives of the invention will be achieved by an diving stick made of a soft, pliable material in which one end has a specific gravity of greater than 1 so that one end will being to sink and take on water. For example, the "weights" at one end of the diving stick may be in the form of a heavier portion of the outer body itself, achieved by varying the composition of the material that makes up the outer body, by injection molding a plug or weight into the outer body, by adding a layer of a heavier material to an end of the outer body, or by simply thickening a portion of the end of the outer body.

While specific materials are described in connection with the preferred embodiments of the invention, those skilled in the art will appreciate that any soft, pliable, material should be considered to be within the scope of the invention. By "soft," "pliable," and/or "malleable" is meant a material that is sufficiently pliable or malleable that it will bend if it encounters a person, and therefore cannot enter any body orifices or cause injury when forcefully struck by another part of the body such as the head. In addition, it will be appreciated that the diving sticks of the invention may be made of multiple materials, that areas of the diving sticks may have a pliability of softness than others, and that the exterior of the diving sticks may include limited areas of rigidity, such as the end cap in the diving stick of the first preferred embodiment of the invention. Alternatively, the material of the outer body may actually be a semi-rigid material such as the woven materials used in lawn chairs or "attorney's handcuffs," so that when formed into a tube and weighted, the material will sink and yet retain its tubular shape even without a substantial amount of filling, while posing no threat of impalement.

In addition, while the diving sticks of the preferred embodiments of the invention are generally in the form of tubes or cylinders, some departures from the generally tubular or cylindrical shape maybe made for decorative or design purposes. For example, diving sticks have in the past been in the shape of sharks, and such generally elongated decorative shapes are considered to be within the scope of the invention.

Finally, while most conventional diving stick are designed to maintain an upright, or vertical posture at the bottom of a swimming pool, it is also within the scope of the invention to provide diving sticks arranged to come to rest at an orientation other than vertical, or to float above the bottom of the pool or body of water so that less skilled divers can still use the sticks.

DETAILED DESCRIPTION OF THE PREFERRED EMBODIMENTS

Figure 1:
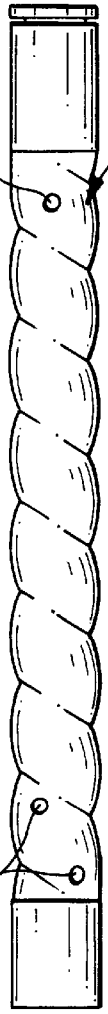
FIG. 1 is a plan view of a diving stick according to a first preferred embodiment of the invention.
Figure 2:
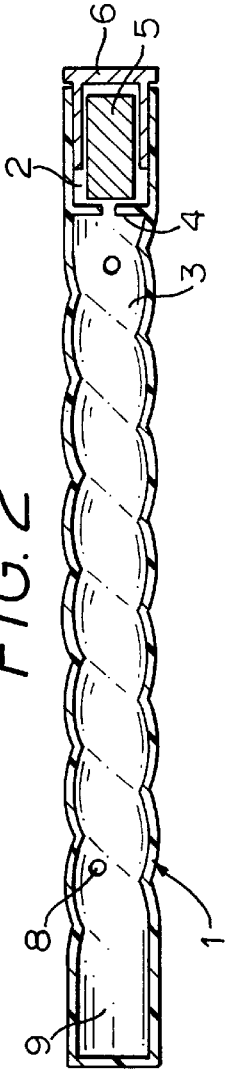
FIG. 2 is a cross-sectional side view of the diving stick of FIG. 1.

As illustrated in FIGS. 1 and 2, the diving stick of the first preferred embodiment of the invention includes a generally cylindrical or elongated body 1 made of a material having sufficient softness and/or malleability to bend when it encounters a person so as 1 include soft polyvinyl chloride and rubber, although the invention is intended to encompass any material with similar properties of softness and malleability.

Body 1 of the diving stick is divided into two sections or chambers 2 and 3, which may be separated from each other by an inwardly extending flange 4. Chamber 2 is arranged to hold a weight 5 and includes an end cap 6 that enables removal of the weight, although those skilled in the art will appreciate that the weight 5 may instead be permanently enclosed within the chamber and the end cap replaced by an end wall of the body 1. The weight 5, may for example be of the approximate size and weight of a 3/16"×½" bolt and nut, although the configuration of the weight may be varied depending on the size and desired sink rate of the stick. In order for the diving stick of this embodiment to work, however, the weight must be confined to the end portion of the stick represented by chamber 2.

Chamber 3 includes at least two openings, one at each end, to permit flow of air and water. In particular, opening 7, which is the opening closest to divider 4 of the illustrated embodiment, is arranged to permit ingress of water while openings 8, of which there are three in the illustrated embodiment are arranged to vent air as water flows into openings 8.

Figures 3A, 3B, 3C:
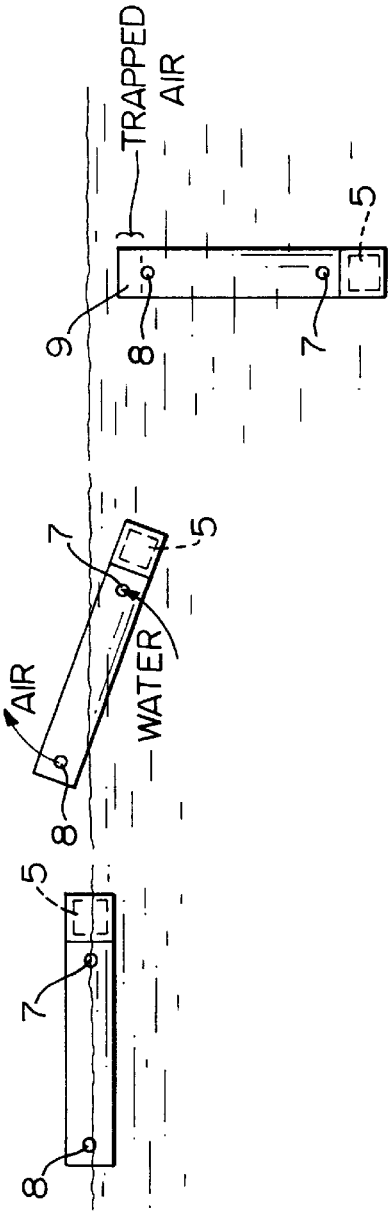
FIGS. 3A–3B illustrate the manner in which the diving stick of the embodiment illustrated in FIGS. 1 and 2 sinks when placed in water.

As a result, when the diving stick of this embodiment is initially tossed into a swimming pool or other body of water, it will initially float in a horizontal orientation. Because one end is weighted, the end of the diving stick containing the weight will dip sufficiently into the water to cause water to begin to enter opening 7, as illustrated in FIG. 3A. As water enters opening 7, air will be expelled through openings 8, as illustrated in FIG. 3B, causing the stick to be filled with water up to the level of the closest of openings 8 to the end of the stick opposite to the weighted end. However, a pocket of air will remain trapped in the end portion of chamber 3, which will cause the stick to maintain an upright orientation as it sinks and comes to rest on the bottom of the pool, as illustrated in FIG. 3C. Once the diving stick is retrieved from the bottom of the pool, the water will flow out through openings 7 and 8 and the stick will be ready for re-use.

Figure 4:
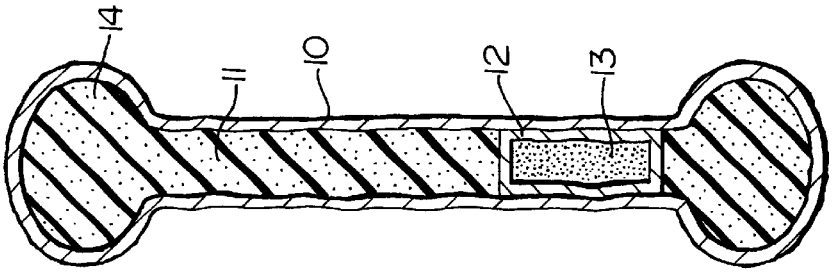
FIG. 4 is a cross-sectional side view of a diving stick according to a second preferred embodiment of the invention.

In the embodiment illustrated in FIG. 4, the diving stick includes an elongated soft body 10 made of a natural or synthetic, water permeable, cloth or fabric material such as polyester or nylon, filled with a soft stuffing material such as foam or polyfill 11. Again, the invention is intended to encompass any materials having properties of softness and pliability corresponding to the described materials, with softness and pliability being defined by the lack of potential for impalement or serious injury to a diver. In this embodiment, the weight is provided by a mesh or cloth sack 12 filled with sand 13 or a similar material will cause the stick to have a preferred orientation as it sinks. The enlarged end 14 opposite the weighted end helps the stick of this embodiment maintain an upright posture by serving as a reservoir for air trapped in the polyfill stuffing material as water is absorbed through the cloth outer layer 10.

Figure 5:
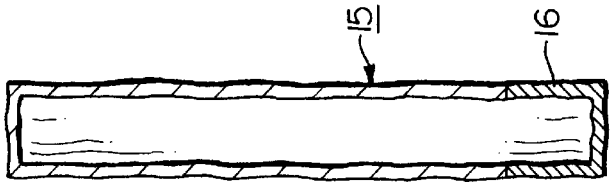
FIG. 5 is cross-sectional side view of a variation of the diving stick of FIG. 4.

In a modification of this embodiment of the invention, the fabric and polyfill construction of the stick illustrated in FIG. 4 may be replaced by a tube of woven material 15, as shown in FIG. 5, that is stiff enough to maintain a generally cylindrical shape without stuffing, and that has a weighted end 16 so that the specific gravity of the tube at the weighted end is greater than 1. This type of tube will sink in the same manner as the conventional diving tube as water enters the tube through the woven material or through openings in the tube, and may optionally include provision for an air pocket at the top to help maintain the upright posture. The material in question is often used in lawn furniture, and also in a novelty device known as the lawyer's handcuff.

Although various preferred embodiments of the invention have been described with sufficient particularity to enable a person skilled in the art to make and use the invention without undue experimentation, it will be appreciated that numerous other variations and modifications of the illustrated embodiments, in addition to those already noted above, may be made by those skilled in the art.

For example, the diving stick may have a shape other than the generally cylindrical shapes illustrated in the drawings, so long as the sticks are generally elongated so as to have a preferred orientation and so long as the sticks can easily be grasped by a diver. In addition, it is possible that other ways of achieving negative buoyancy could be used without departing from the broadest principle of the invention, which is to make the diving sticks of a soft, malleable material in order to eliminate the risk of impalement. For example, although the illustrated embodiments use discrete weights, the illustrated diving sticks may utilize any construction in which one end has a specific gravity greater than 1 (the specific gravity of water) so that the stick will begin to sink and therefore take on enough water to bring the overall specific gravity of the stick to greater than one.

Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

What is claimed is:

1. An elongated object arranged to be tossed into a body of water, sink to a bottom of the body of water, and rest on the bottom while maintaining an upright posture so that it can easily be retrieved by a diver, comprising:

an outer body made of a soft and malleable enough to prevent impalement of the diver, said outer body including an interior chamber and an exterior opening in communication with the interior chamber, said interior chamber having a volume large enough to accommodate sufficient ingress of water when the outer body is tossed into the body of water to overcome a buoyancy of the outer body, and thereby cause the elongated object to sink, wherein said outer body has first and second ends, and wherein when said elongated object is initially tossed into said body of water, said elongated object maintains a substantially horizontal orientation until said ingress of water occurs, a weight of the first end of the elongated object being insufficient by itself to cause a change from said substantially horizontal orientation to a vertical orientation, and a weight confined to the first end of said outer body, wherein the first end of the outer body is adapted to sink before the second end upon said ingress of water into said interior chamber to thereby cause said outer body to change from a horizontal orientation in which the outer body floats upon said surface to a vertical orientation as the outer body sinks below said surface, and to maintain said vertical orientation as it sinks to the predetermined level, wherein said outer body includes at least one opening at said second end of the outer body for permitting egress of air from said interior area to outside said outer body in response to the ingress of water, wherein said second opening is spaced from the second end of the body so that a pocket of air is present in said second end to cause said stick to maintain the upright posture as the elongated object is filled with water, wherein said elongated object further comprises a removable end cap at said first end of the outer body, said end cap being arranged to be removed to permit access to said weight, and wherein said weight is confined between the end cap and a flange extending inwardly from said outer body.

2. An elongated object as claimed in claimed in claim 1, wherein said outer body is made of softened polyvinyl chloride.

3. A diving stick arranged to be tossed into a body of water, sink to a bottom of the body of water, and rest on the bottom while maintaining an upright posture so that it can easily be retrieved by a diver, comprising:

an outer body made of a material soft and malleable enough to prevent impalement of the diver, wherein said outer body has first and second ends, wherein a weight of said first end of the outer body is insufficient to cause said outer body to change from an initial substantially horizontal orientation to a preferred upright posture upon being tossed into said body of water, and wherein said first end of said outer body is nevertheless adapted to sink below the surface before the second end of said outer body sinks below the surface and to cause the outer body to maintain said preferred upright posture as it sinks to the bottom of the body of water and rests on the bottom, and further comprising a weight made up of sand confined in a separate enclosure at said first end of the object.

4. A diving stick as claimed in claimed in claim 3, wherein said outer body is made of softened polyvinyl chloride.

5. A diving stick as claimed in claim 4, wherein said outer body is filled with a stuffing material.

6. A diving stick as claimed in claim 5, wherein said stuffing material is polyfill.

7. A diving stick as claimed in claim 3, wherein said outer body is made of a water permeable fabric material.

8. A diving stick arranged to be tossed into a body of water, sink to a bottom of the body of water, and rest on the bottom while maintaining an upright posture so that it can easily be retrieved by a diver, comprising:

an outer body made of a material soft and malleable enough to prevent impalement of the diver, wherein said outer body has first and second ends, wherein a weight of said first end of the outer body is insufficient to cause said outer body to change from an initial substantially horizontal orientation to a preferred upright posture upon being tossed into said body of water, and wherein said first end of said outer body is nevertheless adapted to sink below the surface before the second end of said outer body sinks below the surface and to cause the outer body to maintain said preferred upright posture as it sinks to the bottom of the body of water and rests on the bottom, wherein said outer body includes an opening at said first end of the body for permitting ingress of water into an interior area defined by an outer surface of the outer body, and at least one opening at said second end of the outer body for permitting egress of air from said interior area to outside said outer body in response to the ingress of water, and further comprising a weight confined to the first end adjacent the first opening, and wherein said second opening is spaced from the second end of the body sufficient to cause a pocket of air to be present in said second end and thereby cause said stick to maintain the upright posture as the stick is filled with water.

9. A diving stick as claimed in claim 8, further comprising an end cap at said one end of the outer body, said end cap being removable to permit access to said weight.

* * * * *